US012225992B2

(12) United States Patent
Thomas

(10) Patent No.: US 12,225,992 B2
(45) Date of Patent: Feb. 18, 2025

(54) HANDBAG USABLE WITH INTERCHANGEABLE COVER

(71) Applicant: Anita Thomas, Las Vegas, NV (US)

(72) Inventor: Anita Thomas, Las Vegas, NV (US)

( * ) Notice: Subject to any disclaimer, the term of this patent is extended or adjusted under 35 U.S.C. 154(b) by 268 days.

(21) Appl. No.: 17/827,756

(22) Filed: May 29, 2022

(65) Prior Publication Data

US 2022/0287423 A1 Sep. 15, 2022

Related U.S. Application Data

(63) Continuation-in-part of application No. PCT/US2022/016036, filed on Feb. 10, 2022, which is a continuation-in-part of application No. 29/770,362, filed on Feb. 11, 2021, now Pat. No. Des. 1,010,312, application No. 17/827,756 is a continuation-in-part of application No. 29/770,362, filed on Feb. 11, 2021, now Pat. No. Des. 1,010,312.

(60) Provisional application No. 63/148,308, filed on Feb. 11, 2021.

(51) Int. Cl.
*A45C 3/08* (2006.01)
*A45C 13/08* (2006.01)

(52) U.S. Cl.
CPC ..... *A45C 3/08* (2013.01); *A45C 13/08* (2013.01)

(58) Field of Classification Search
CPC ..... A45C 3/08; A45C 13/08; B65D 33/02; B65D 33/007; B65D 33/14
USPC ..... 150/105, 103, 104
See application file for complete search history.

(56) References Cited

U.S. PATENT DOCUMENTS 2,036,608 A 4/1936 Rosenberg
2,118,400 A 5/1938 Goldberg
2,131,382 A * 9/1938 Lobel ..... A45C 3/08 150/105
2,570,851 A 10/1951 Irving
2,609,854 A 9/1952 Mitchell
2,694,427 A 11/1954 Hovis
(Continued)

FOREIGN PATENT DOCUMENTS

DE 20301158 U1 * 3/2003 ..... A45C 13/04
DE 202014104176 U1 9/2014

OTHER PUBLICATIONS

English translation of DE 202014104176 U1.
(Continued)

*Primary Examiner* — Don M Anderson
*Assistant Examiner* — Jessica Kavini Tamil
(74) *Attorney, Agent, or Firm* — Connie R. Masters

(57) ABSTRACT

A handbag is provided that includes a base bag that is usable alone or usable with one or more attachable and replaceable outer covers. The base bag includes loop-forming tabs disposed in a series along the top of the base bag that serve as decoration, serve as beltloops for receiving an elongated article (belt, scarf, etc.), serve for attaching accessories, and serve to attach the cover. The loop-forming tabs each include a tab connector that is attachable to, and detachable from, a corresponding base connector on the outside of the base bag to form a two-connector interconnection. The interchangeable cover, when installed, encloses more than half of the bottom portion of the base bag. The cover also includes a series of interconnection-receiving apertures near its top edge that each accommodate a two-connector interconnection to hold the cover onto the base bag.

21 Claims, 10 Drawing Sheets

(56) References Cited

U.S. PATENT DOCUMENTS

| | | | | |
|---|---|---|---|---|
| 3,234,985 | A | 2/1966 | Stephen | |
| D658,366 | S | 5/2012 | Platt et al. | |
| D659,389 | S | 5/2012 | Platt et al. | |
| D665,176 | S | 8/2012 | Platt et al. | |
| 8,684,054 | B2 | 4/2014 | Platt et al. | |
| 9,198,489 | B2 | 12/2015 | Romero et al. | |
| 9,622,559 | B2 | 4/2017 | Pace et al. | |
| 10,058,157 | B2 | 8/2018 | Brazzel et al. | |
| 10,238,193 | B2 | 3/2019 | Echelman | |
| 2006/0032875 | A1 | 2/2006 | Patterson | |
| 2009/0025842 | A1 | 1/2009 | Courville | |
| 2009/0026240 | A1* | 1/2009 | Wang | A45C 3/06 383/105 |
| 2009/0065110 | A1 | 3/2009 | Cassella | |
| 2017/0135453 | A1 | 5/2017 | Lo et al. | |
| 2017/0150791 | A1 | 6/2017 | Ocleppo | |

OTHER PUBLICATIONS

International Search Report dated Apr. 28, 2022 for International Application No. PCT/US22/16036 filed on Feb. 10, 2022.

Poshmark listing of Michael Kors Jet Set Saffiano Leather Scarf Tote, accessed Feb. 11, 2021.

Written Option of International Search Authority dated Apr. 28, 2022 for International Application No. PCT/US22/16036 filed on Feb. 10, 2022.

* cited by examiner

HANDBAG USABLE WITH INTERCHANGEABLE COVER

FIELD OF INVENTION

This invention relates generally to purses and hand carried bags, and, more particularly, to a handbag that can be modified in appearance by utilizing removable covers or elongated articles.

BACKGROUND OF THE INVENTION

Handbags are a fundamental part of most women's wardrobes. They serve an important function in terms of carrying essential items that are required throughout the day, and they also may complement an outfit and/or provide a sense of expression. Most women have multiple handbags in their closet. While specific numbers are elusive, it has been estimated that the average number of handbags is between 6 and ii bags per person. At times, women will select a unique bag for distinct functions, such as selecting a rugged bag for an outdoor outing or an elegant bag for a formal occasion. Or a woman may be inclined to rotate her handbags based on a change in tastes or trends, or simply to be more playful and complete different outfits. But preferences and consumption inclinations in this market are shifting. In 2019 (pre pandemic), U.S. sales of women's handbags and totes were down by over 20% during the first eight months of the year compared to three years prior, according to NPD Group. No longer are women interested in spending money on excess numbers of handbags; therefore, a more versatile bag is now desired. Additionally, preferences are changing among the younger demographic, who also prefer a more minimalistic style, which could be addressed by a multipurpose bag instead of multiple bags. As NPD Group analyst Beth Goldstein stated, "Today's consumer is looking for a solution, not just a bag."

Regardless of how many bags a woman may have in her closet, she often resorts to an everyday bag—a tried and true staple that does the job almost every day of the week. The problem is that this can get a bit boring. And when it does come time for the woman to change her handbag for different occasions or based on wardrobe preferences, all of the contents of the initial bag need to be transferred into the newly selected bag. This creates an inconvenience, uses extra time, and increases the likelihood of neglecting to move an item to the new bag. An additional problem is that investing in more than one handbag is expensive. Further, storing multiple bags is undesirable as it uses extra space in closets.

Known prior creations include Magnolia and Vine's Versa line of handbags (associated with the trademark MICHE) with interchangeable handbag top closing flaps. In this handbag, a base bag exists along with an outer flap that changes the look of the base bag. The outer flap is attached via magnets, but the inner bag does not offer a sleek appearance for use on its own, as the magnets protrude against the material of the bag front and cause a highly visible indentation until covered by the attachable component. This makes it essential to marry the top closing flap to the base bag component prior to use. Also, as only a top closing flap is provided, the appearance of the base bag itself is not changed. No cover is available to change the look of the base bag or to allow washing of the cover for hygiene.

Another prior art creation is presented by Pelli Couture, as seen at https://pellicouture.com, which touts a handbag with a cover that is secured by a cover-fastening zipper around the entire upper periphery of the cover. The cover-fastening zipper is hidden under an exterior horizontal zipper-concealing flap. Neither the exterior zipper-concealing flap nor the cover-fastening zipper serve any function other than to secure the outer cover to the base bag; this creates unnecessary bulk. It would be advantageous if the cover-fastening elements served additional functions. Also, the flat bottom of the base bag and the cover do not provide feet to elevate the bag or cover off the ground to preserve the flat bottoms from dirt and wear, which would be advantageous.

Though a number of attempts have been made to provide handbags with interchangeable portions, the prior art solutions present deficiencies in a number of areas. Many of the handbag systems offer a base bag that is not fully designed with an intent to be used on its own, but rather demands the use of outer covers or accessories in combination with the base bag. Others do not offer different styling options on the base bag itself, but only provide the option to change the cover. Several handbags that provide an ability to change the outer cover rely on the use of zippers around the top periphery of the bag as a cover-attachment element, which dedicates the usage of the zipper merely to this attachment function. Other bag covers do not attach securely and efficiently, but instead allow the cover to gap between cover-fastening elements along the top which leaves gaps or sagging areas.

Accordingly, there is a need for a handbag that advantageously combines a base bag that is suitable for using alone or for using with one or more interchangeable covers, and in which the tabs serving as cover-attachment elements can also be utilized for both attaching a cover and for other functions regardless of whether a cover will be attached or interchanged. This is all achieved while not utilizing dedicated-purpose zippers as cover-attachment elements for interchanging the cover, which do not provide multi-purpose functionality.

The discussion above is merely provided for general background information and is not intended to be used as an aid in determining the scope of the claimed subject matter.

BRIEF SUMMARY OF THE INVENTION

The present invention is directed to a highly stylized ladies' handbag comprising a fully functional base bag usable alone, usable with one or more interchangeable outer covers, and usable with an ancillary elongated element (such as a scarf, belt, chain, etc.). Additional accessories (keys, cases, pouches, ID badges, face masks, etc.) can also be attached and carried. The same tab system that allows the attachment and detachment of the cover also separately and securely holds an ancillary elongated element and/or accessories.

The base bag includes an outer member that defines a hollow interior. The outer member includes an upper portion and a lower portion. The upper portion is configured with a collar disposed at or near the top of the upper portion and with multiple base connectors disposed below the collar of the base bag. Multiple loop-forming tabs have a proximal portion attached at, near, or above the top of the collar (at or near the top perimeter of the bag) and have a distal portion that extends downwardly to the area of the base connectors. Preferably the tabs may be teardrop shaped, as shown. The tabs are configured with tab connectors that are complementary to the base connectors. Each of the tab connectors is manually connected to one of the base connectors to form a two-connector interconnection to create and define a belt-loop-type open space under each tab (between the collar exterior surface and the tab interior surface), to create a location onto which accessory items may be attached, and to hold a cover onto the base bag.

The cover comprises a five-sided enveloping casing with an open top that is raised from the bottom of the base bag to envelope or cover over one half of the base bag. The enveloping casing includes a cover front, a cover back, two cover sides, and a cover bottom. A series of interconnection-receiving apertures is disposed at least along the upper portion of the cover front and cover back; each of the apertures is configured to receive the two-connector interconnection formed when the tab connector (on the distal or lower portion of the loop-forming tab) connects to the base connector. In other words, when the cover is to be installed, the cover is pulled upwardly over the bottom of the bag with the top of the cover at or near the collar, and then each tab connector is connected to one of the base connectors through one of the interconnection-receiving apertures of the cover.

The cover preferably includes cover bottom openings disposed on the bottom of the cover, such as grommets or other reinforced openings, which are configured to receive feet disposed on the bottom of the base bag. The use of base bag feet extending through the attachable cover lengthens the life of the cover and enhances the neat and tidy appearance of the handbag.

Preferably the front and back of the bag are configured with three or more tabs (and tab-to-base interconnections). This allows the cover to be supported at three or more points on both the bag front and the bag back. Most preferably four or more tabs and interconnections are provided to fully support the top perimeter of the cover and to increase the structural integrity of the handbag cover. If fewer tabs are used, the outer cover could slack and create a less-than-desirable aesthetic and presentation. The use of at least three and preferably at least four tabs on each of the bag front and the bag back allows the cover to have a supported, sleek appearance.

In an exemplary use, small accessories (such as keys, hand sanitizer, face masks, sunglasses, or the like) may be attached to the loop-forming tabs. This provides easy access and convenience.

In a further exemplary use, whether or not the tabs are also used to connect accessories, an ancillary elongated element, such as a decorative belt, scarf, chain, wire, rope, necklace, or the like, may be threaded through the open spaces between the collar and tabs to add interest or to change the look of the handbag.

In an aspect of the invention, the cover also includes two securing side flaps, which, along with the front tabs, may secure a decorative ancillary elongated element. In this aspect, the elongated element is preferably run through the front and back beltloop-type open spaces (which are disposed on the front and back of the base bag) and through the side-flap open spaces (which are disposed on the side of the cover).

In another aspect of the invention, the base bag front, back, and sides are configured with belt/scarf slits that accommodate an ancillary elongated element. In this aspect, the ancillary elongated element is preferably run through both the beltloop-type open spaces and the belt/scarf slits.

In an additional aspect of the invention, both belt/scarf slits and side-flap open spaces are included, which allows the ancillary elongated element to be run through three types of open spaces. The base bag provides two of the types of open spaces, the beltloop-type open spaces and the belt/scarf slits. The cover provides the third type of opening to receive the ancillary element, which is the side-flap open spaces.

The present invention provides advantages over the prior art due to the multi-purpose functionality provided by the specific combination of elements. The present invention allows use of the base bag alone. The present invention also includes loop-forming tabs that can used for multiple, independent functions. They may be used to attach a replaceable outer cover, may be used to receive an ancillary elongated element, and may be used to hold or connect small accessories. This provides a practical and an extended functionality of the handbag compared to known prior art bags.

The instant invention is also an improvement to known prior art in that the design of the present invention allows the handbag to be uniquely customized in ways that go beyond simply changing the outer cover, such as changing the type or look of the ancillary elongated element. For example, when the ancillary elongated element is a belt, an individual can remove the detachable belt situated in the top collar of the bag and exchange it for a belt of a different style, a different color; or an altogether different decorative item can be substituted, such as a scarf. This creates limitless possibilities for the handbag's appearance, giving each user a chance to achieve a truly unique look which goes far beyond the styling options afforded in other handbags or handbag systems.

The usability of the handbag is multiplied by the fact that the owner can independently select from multiple ancillary elements, removable covers, and accessories, because these three types of elements are independently attachable, detachable, and interchangeable. Although individuals may own identical covers, no two bags need ever to be identical due to the versatility and styling options that this inventive design affords.

Thus, the handbag of the current invention provides a serviceable base bag for use alone or with an assortment of decorative ancillary elongated elements or accessories and provides a base bag for use with one or more interchangeable covers, which can also be enhanced by the addition of ancillary elongated elements or accessories. The tab-type cover-attachment elements can be utilized not only to attach the cover, but also for other functions regardless of whether a cover will be attached. The inventive handbag does not utilize dedicated-purpose zippers as cover-attachment elements that add unnecessary bulk. It incorporates multiple elements that work in synergy to provide functionality beyond what is available in the prior art.

In one aspect of the invention, a kit comprising one base bag and one cover is provided.

In an additional aspect of the invention, a kit comprising one base bag and multiple interchangeable covers is provided.

In another aspect of the invention, the cover is reversible.

In a further aspect of the invention, the cover is washable.

In an additional aspect of the invention, multiple covers are stackable.

In another aspect of the invention, the base connectors and tab connectors are complementary. The base connectors and tab connectors may comprise complementary snaps, a button and buttonhole system, a complementary magnetic system, complementary hook and loop system, or a complementary hook and eye system.

In an additional aspect of the invention, the cover includes opposing side securing flaps on the cover sides carrying flap couplings and complementary cover couplings disposed on the cover sides. The flap couplings and cover couplings may comprise complementary snaps, a button and buttonhole system, a complementary magnetic system, complementary hook and loop system, or a complementary hook and eye system.

In a further aspect of the invention, the cover does not include cover side flaps.

In another aspect of the invention, the base bag further includes a bag side loop for receiving a cover side securing flap.

The object of the invention is to provide a handbag with one or more removable covers that gives an improved performance over the above-described prior art handbags.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Figure 1:
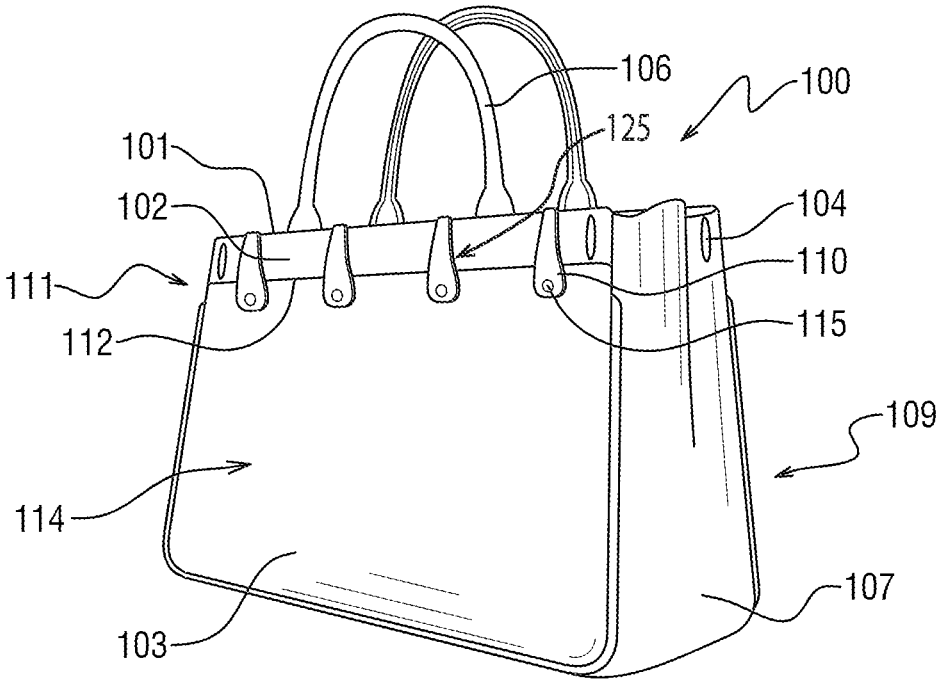
FIG. 1 is a perspective view of a base bag of an embodiment of the present invention.
Figure 2:
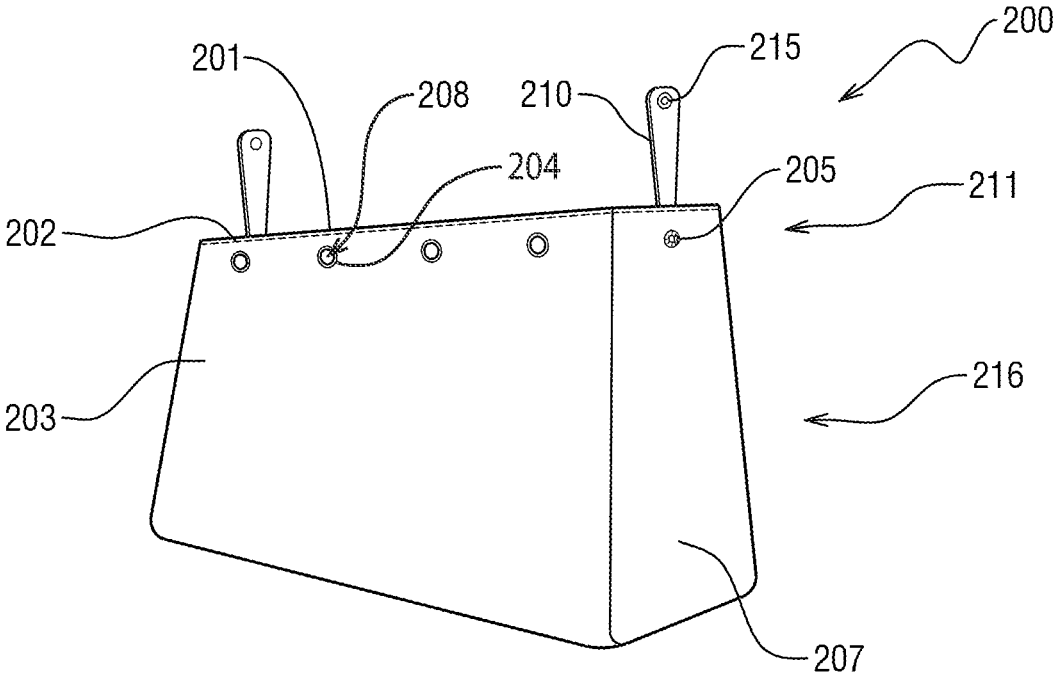
FIG. 2 is a perspective view of an outer cover of an embodiment of the present invention for use with the base bag of FIG. 1.
Figure 3:
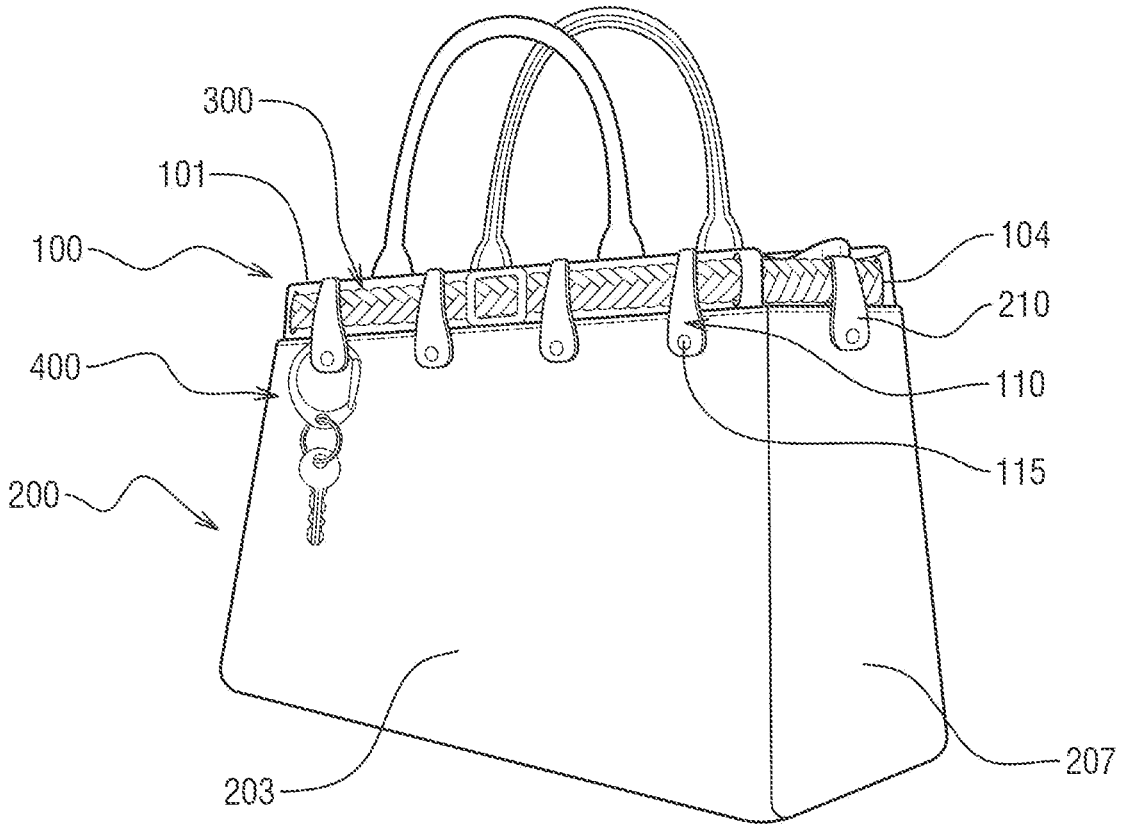
FIG. 3 is a perspective view of the base bag and outer cover combination of an embodiment of the present invention, where the cover is fitted onto the base bag, where a belt-type ancillary elongated element is installed within loops formed by the tabs of the base bag and the two flaps of the cover, and where a key-type attachable personal accessory is attached to a tab.

Shown throughout the figures, the present invention is directed toward a versatile handbag, which includes a base bag 100 (shown in FIG. 1), that is usable alone, that is usable with one or more removable and replaceable outer covers 200 (shown in FIG. 2), and that is usable with one or more removable and replaceable ancillary elongated members 300 (shown in FIG. 3), and that is usable to carry small attachable personal accessories 400 (FIG. 3). The base bag includes tabs 110 installed onto the upper portion 111 of the base bag 100 that form a series of loops extending downward from at or near the top edge 101 of the upper portion 111 of the base bag 100. The loops formed by the tabs 110 may be used to attach and detach the cover 200 and/or an ancillary elongated element 300 (belt, scarf, chain, etc.), and/or small attachable personal accessories 400 (keys, ID badge, face mask, etc.).

Figure 7:
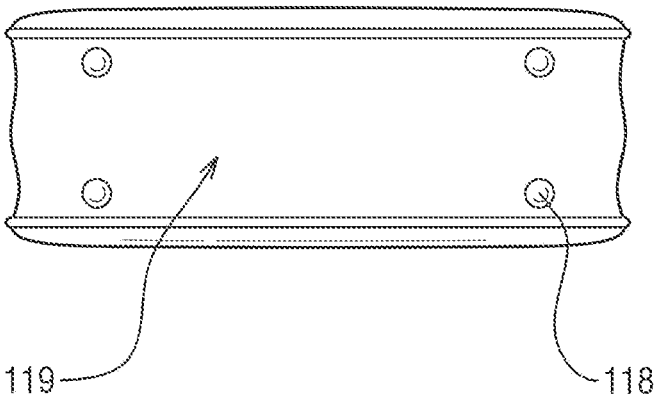
FIG. 7 is a bottom view of the base bag of an embodiment of the present invention showing multiple feet.
Figure 9:
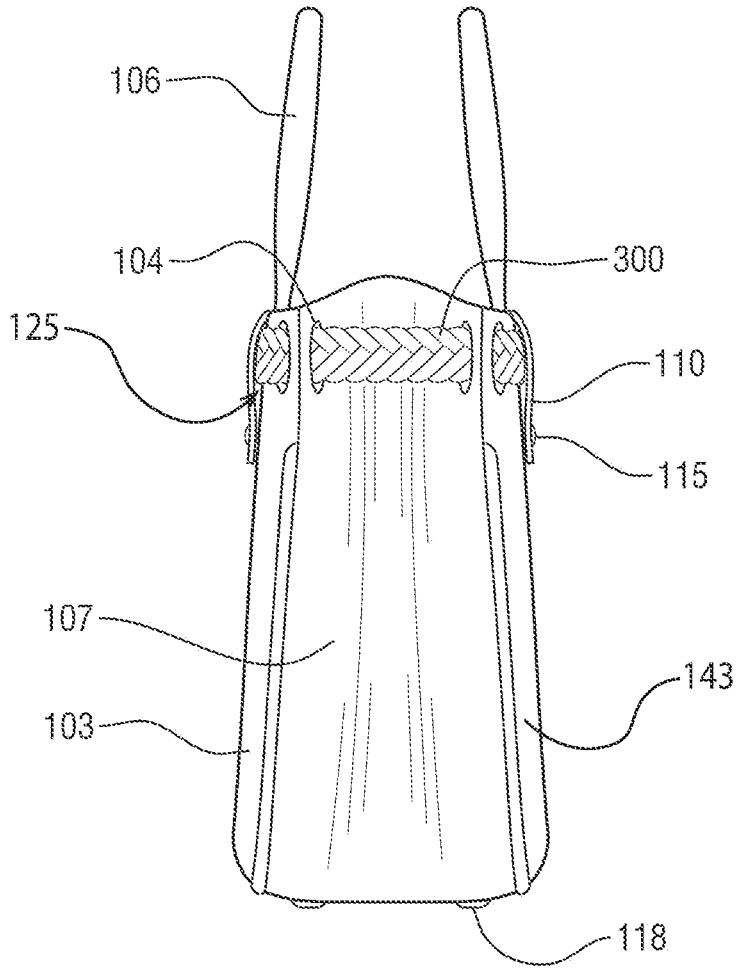
FIG. 9 is a side view of the base bag of an embodiment of the present invention with a belt-type ancillary elongated element included.
Figure 10:
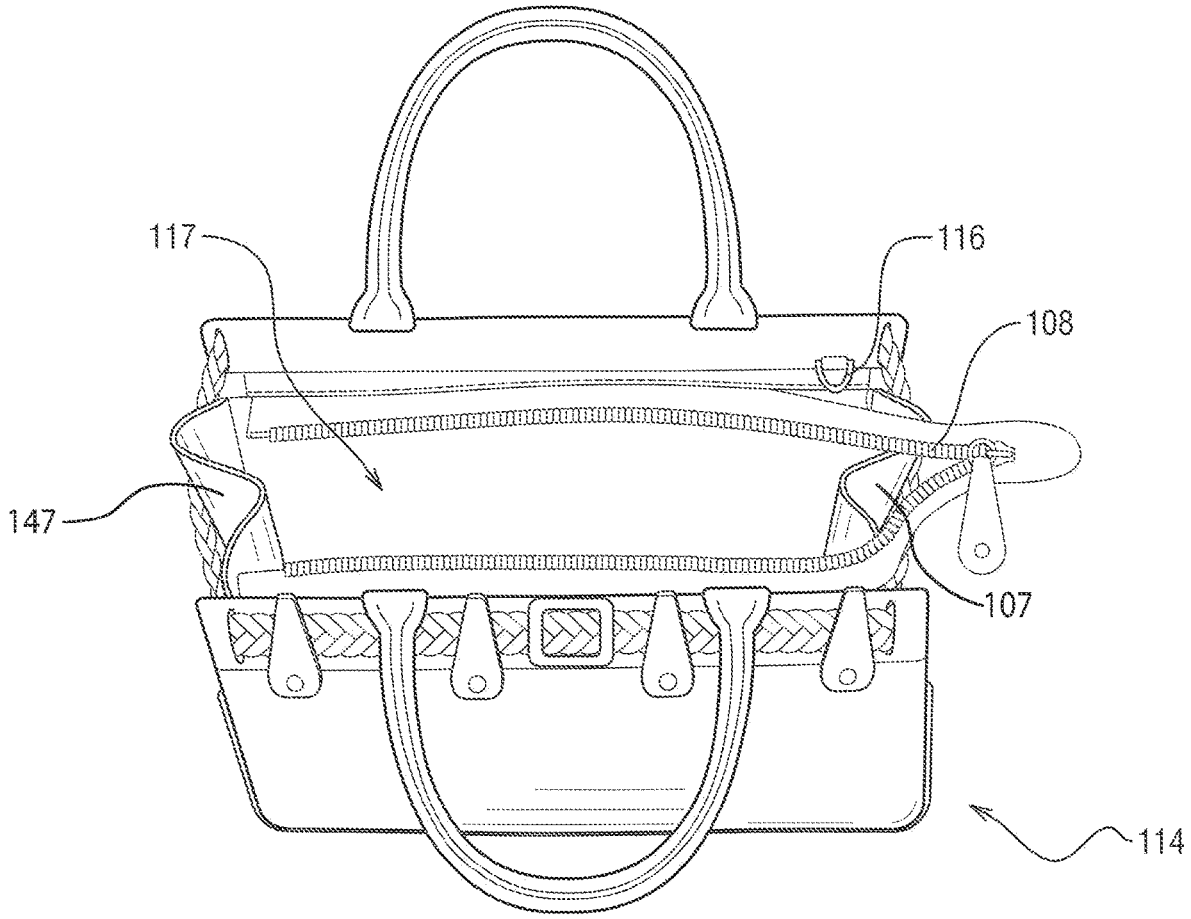
FIG. 10 is a top perspective view of the base bag of an embodiment of the present invention with a belt-type ancillary elongated element included.

The base bag 100 comprises sides 107, 147 (FIG. 10), a bottom 119 (FIG. 7), a front 103, and an opposing back 143 (FIG. 9) that together form a bag housing 114. The interior of the bag housing 114 defines an open interior compartment 117 (FIG. 10). The open interior compartment 117 may be configured with open pockets, zipper pockets, snap pockets, pouches, and other standard handbag interior cavities for receiving items to be carried in the handbag. The base bag 100 may further comprise a closing mechanism 108 to form a closure for the open interior compartment 117. The closing mechanism 108 may comprise any known bag closure, such as a zipper, complementary magnetic components, snaps, or other known closing mechanisms.

The base front 103 and base back 143 include a base upper portion 111 and a lower portion 109. The base upper portion 111 is disposed within the top half of the base bag 100. The base lower portion 109 includes at least the bottom half of the base bag 100.

Figure 4:
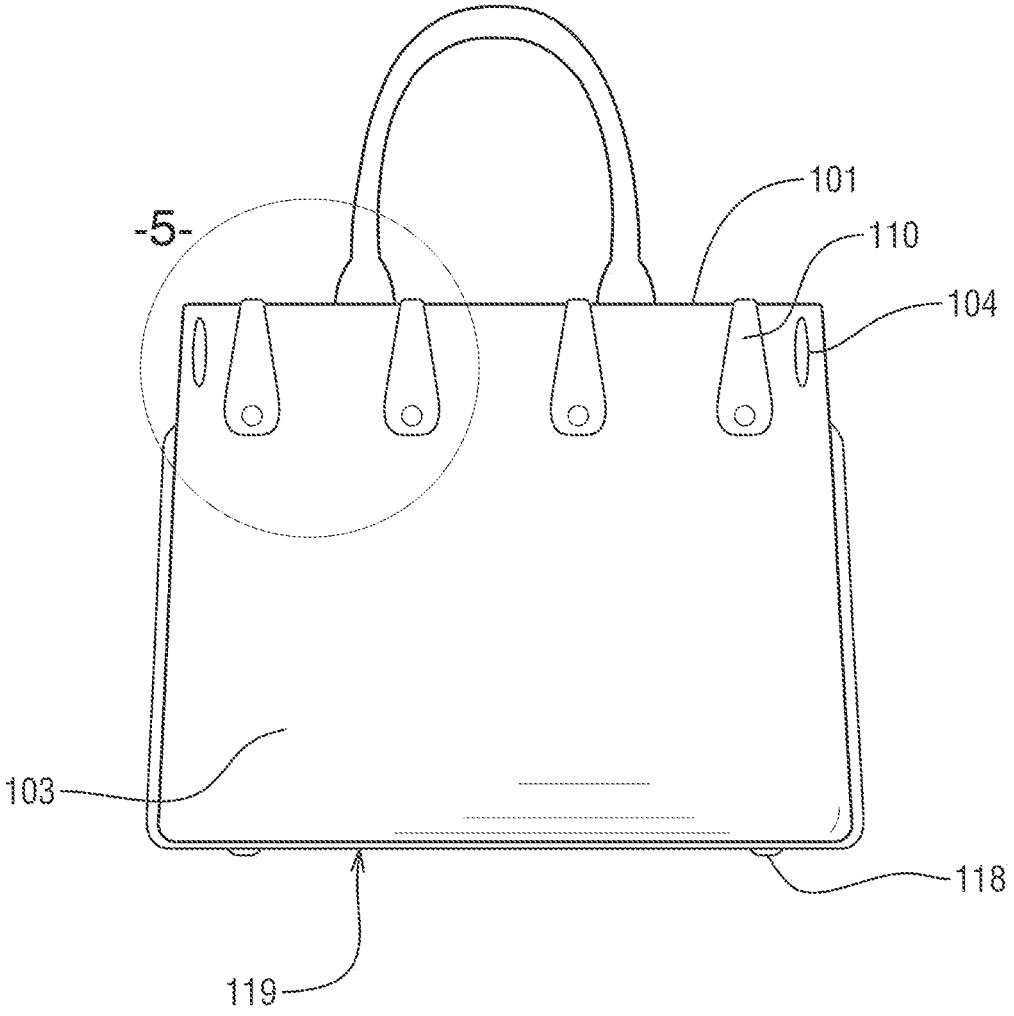
FIG. 4 is a front view of the base bag of an embodiment of the present invention with the base connectors disposed on the outer member of the base bag connected to, and forming a two-connector interconnection with, the tab connectors carried by the multifunction loop-forming tabs.

The base upper portion 111 includes a collar 102 disposed along the top of the upper portion 111 of the base bag 100. The collar 102 meets the remaining portion of the base bag 100 at collar lower junction 112. The collar 102 preferably extends from the bag top edge 101 downward a vertical height of up to 50% of the total vertical height of the base bag 100. Preferably, the collar extends a vertical height of less than 25% of the vertical height of the base bag 100. In the aspect shown in FIG. 1, the collar 102 is a defined strip or band. In an aspect shown in FIG. 4, the collar 102 is not structurally defined, but is an area identified by its location at or near the top of base upper portion 111 and below the series of tabs 110.

Figure 5:
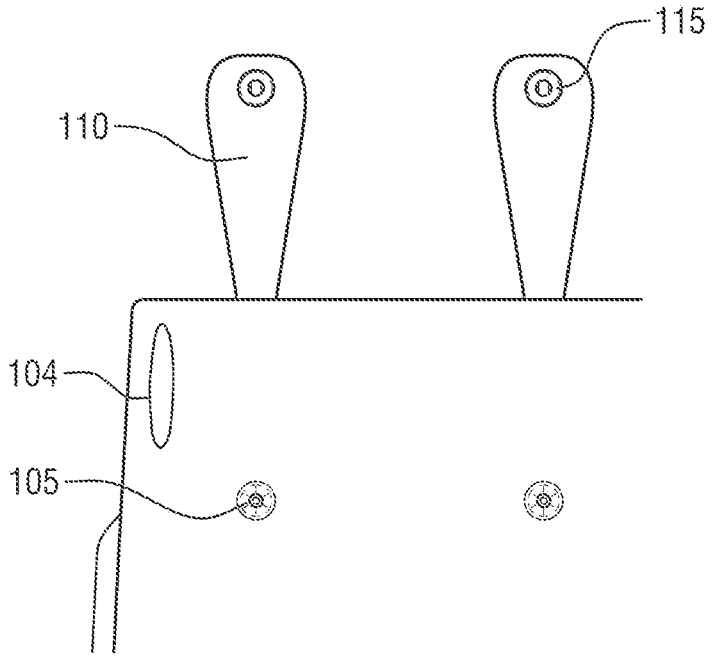
FIG. 5 is a detail view of the top left corner of a base bag of the area designated -5- on FIG. 4, but, in contrast with FIG. 4, the base connectors are disconnected from the tab connectors.
Figure 6:
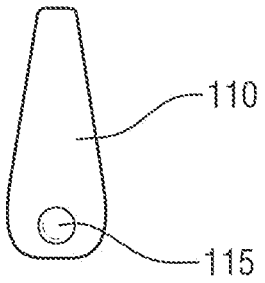
FIG. 6 is a front view of the outside of one loop-forming tab of an embodiment of the present invention.

Multiple base connectors 105 (FIG. 5) are attached to the bag upper portion 111 below the collar 102. These include base connectors 105 attached at the base bag front to form a front base connector series and base connectors 105 attached at the base bag back in a back base connector series. Each of these base connectors 105 disposed on the base bag 100 is complementary to, and connectable with, a tab connector 115 located on the distal portion of a tab 110. The base connectors 105 and tab connectors can be any type of complementary connectors, such as, for example, magnets or a magnet and metal combination, buttons and buttonholes, a hook and eye system, a hook and loop system, complementary snaps, or the like.

Multiple multifunction tabs 110 each have a proximal end attached at, near, or inside the top edge 101 on both the back 143 (forming a back tab series) and front 103 (forming a front tab series) of the base bag 100. They may give the appearance of attaching at or of folding over the top edge 101. In a preferred aspect of the invention, each tab 110 has a greater vertical height than its horizontal width, and, in a preferred aspect, each tab 110 is teardrop shaped. The tabs 110 have a height greater than the height of the collar 102.

Each of the multifunction tabs 110 includes at least one tab connector 115 that is complementary to, and configured to connect to, one of the base connectors 105 disposed on the base upper portion 111. In use, when the base connector 105 is connected to the tab connector 115, a two-connector interconnection 105/115 is formed. The tab connector 115 is disposed toward the bottom or distal portion of the tab 110 to allow for a distance between the tab connector 115 and the top or proximal attachment point of the tab 110. Because the tab 110 is only attached at its top and at the two-connector interconnection 105/115, a beltloop-type open space 125 is defined under it. The beltloop-type open space 125 is an opening inside a loop. It is disposed between the exterior surface of the collar and the interior surface of the tab. The series of between-collar-and-tab open spaces 125 may serve as a channel or passageway, which has an appearance and functionality similar to a channel under a series of beltloops. A decorative ancillary elongated element 300 (such as a belt, scarf, chain, wiring, or the like) may be threaded through this base-tab passageway. The ancillary elongated element 300 may be used to provide functional advantages (such as providing structural integrity or additional strength to the area) or decorative options to the user.

In addition to providing a channel through the beltloop-type open spaces 125 to allow weaving of an elongated scarf 300, the tabs 110 also provide structure upon which to wrap a scarf to create a bow that is positioned in a specific, desired location.

In another aspect the multifunction loop-forming tabs 110 are used for connecting and carrying small attachable items 400, such as a key ring, glasses, or hand sanitizer. Thus, the multifunction tabs 110 not only function to secure the cover 200 and to hold the elongated element 300, but they also provide the advantage of additional, impromptu storage for attachable items 400 that can be hung on the exterior of the bag, such as sunglasses, face masks, ID badges, etc. Whereas outer pockets are widely regarded as the default storage area on the exterior of handbags, this design utilizes the tabs 110 as a mechanism for storing and carrying items that can be hooked around the tabs 110 (after the base connector 105 and the tab connector 115 are manually connected). This increases the function of the exterior of the handbag by providing useful transport of items where a pocket may otherwise be needed. This is true whether the base bag 100 alone is in use, or the cover 200 is applied.

Figure 12:
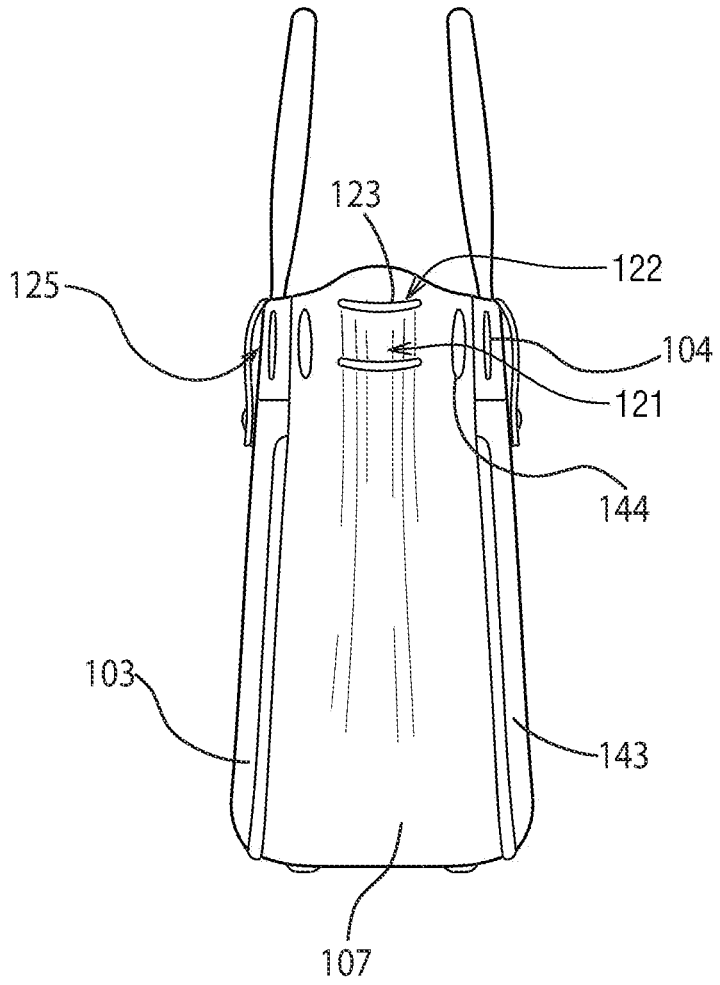
FIG. 12 is a side view of the base bag of an aspect of the present invention showing a horizontal band to receive a side securing flap of the cover.
Figure 13:
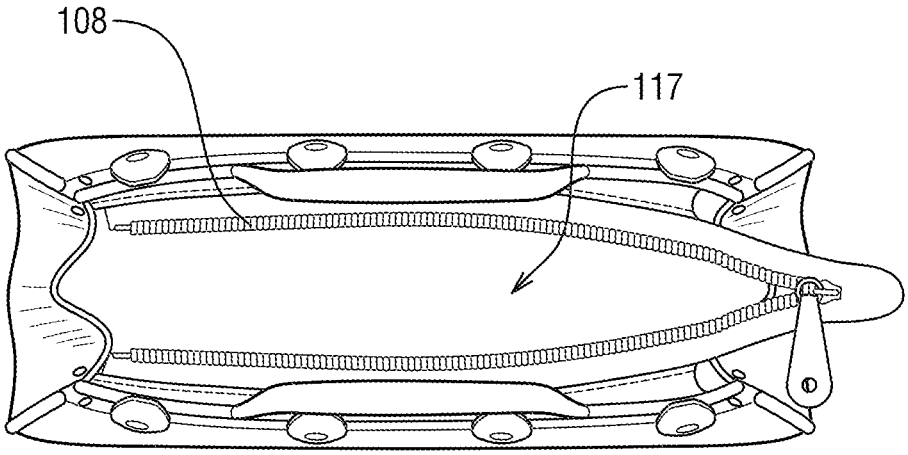
FIG. 13 is a top view of the base bag of an embodiment of the present invention without an ancillary elongated element.
Figure 14:
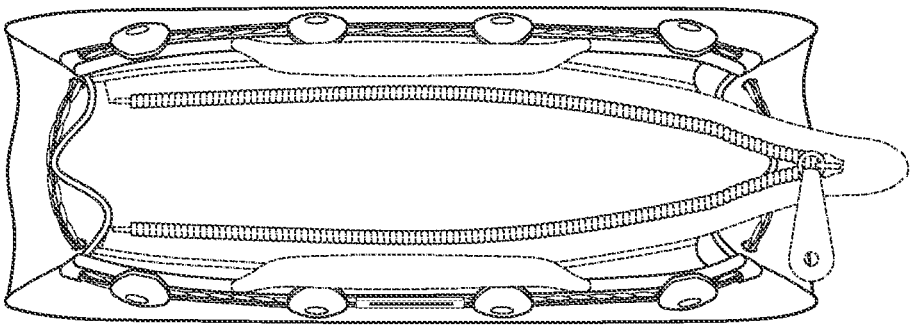
FIG. 14 is a top view of the base bag of an embodiment of the present invention without a belt-type ancillary elongated element.

In an aspect of the invention, through-slits are provided to create additional pathways through which the ancillary elongated element 300 may be woven to hold the elongated element 300 properly in place. The through-slits are vertically elongated openings that extend through the material of the base bag. They are sized to accommodate the elongated element 300. The through-slits include two front and two back through-slits defined by slit edges 104 and two left side and two right side through-slits defined by side slit edges 144 (FIG. 12). The front and back through-slits are disposed near the top outer corners of the front and back, respectively. The side through-slits are disposed near the opposing top outer corners of the opposing sides.

A front right through-slit (defined by slit edges 104) is disposed near the upper right edge of the base bag front to form a through opening extending through the right upper corner of the base bag front 103 into the interior of the base bag. Similarly, a front left through-slit (defined by slit edges 104) is disposed near the upper left edge of the base bag front to form a through opening extending through the left upper corner of the base bag front 103 into the interior of the base bag. The back right and left through-slits (defined by slit edges 104) are disposed similarly, with the back slits being a mirror image of the front slits. The back right through-slit creates an opening from the upper right edge of the base bag back into the bag interior; the back left through-slit creates an opening from the upper left edge of the base bag back into the bag interior.

Two opposing side through-slits (defined by side slit edges 144) are disposed at the upper top corners of the base bag side 107. On each base bag side 107, the upper right-side slit is disposed at the upper right top corner, and the upper left side slit is disposed at the upper left top corner.

The front and back through-slits and the side through-slits correspond in size and location; this facilitates the threading of the elongated element 300 through adjacent slits. For example, a belt may be threaded through the one or more beltloop-type open spaces 125 on the base bag front 103, and through a front right slit and into the interior of the bag. Then the belt is brought from the interior of the bag out through an upper left side slit on the first bag side, across the side, and back to the interior of the bag through an upper right side slit on the first bag side. The belt comes back to the exterior of the bag through a top left back slit, then through beltloop-type open spaces 125 on the base bag back 143, and through a top right back slit to enter the interior of the bag. Then the belt exits through a first upper side slit on the second bag side and enters the bag interior through a second upper side slit on the second bag side. Then the belt exits the interior of the bag through an upper left front slit and proceeds through one or more beltloop-type open spaces 125 on the base bag front 103. Thus, the front and back slit edges are aligned with the side slit edges and are further aligned with the beltloop-type open spaces 125 to provide an aligned pathway through which the ancillary elongated element 300 may be threaded.

Though the front/back slits and the side slits are described as separate, the adjacent slits may be combined into a single slit. In this case, for example, the elongated member 300 could travel from a front beltloop-type open space 125 through the combined right front slit and forward side slit without entering the interior of the bag. Then the elongated member would thread through the combined rearward side slit and the adjacent back slit, through back front beltloop-type open spaces 125 to the two combined slits on the other two corners of the base bag 100.

The inclusion of the slits on the corners of the base bag 100 affords greater opportunity for customization of the handbag, whether it is used with or without a cover. Varied materials can be used by a consumer as elongated members 300 to modify the look of the handbag.

Figure 11:
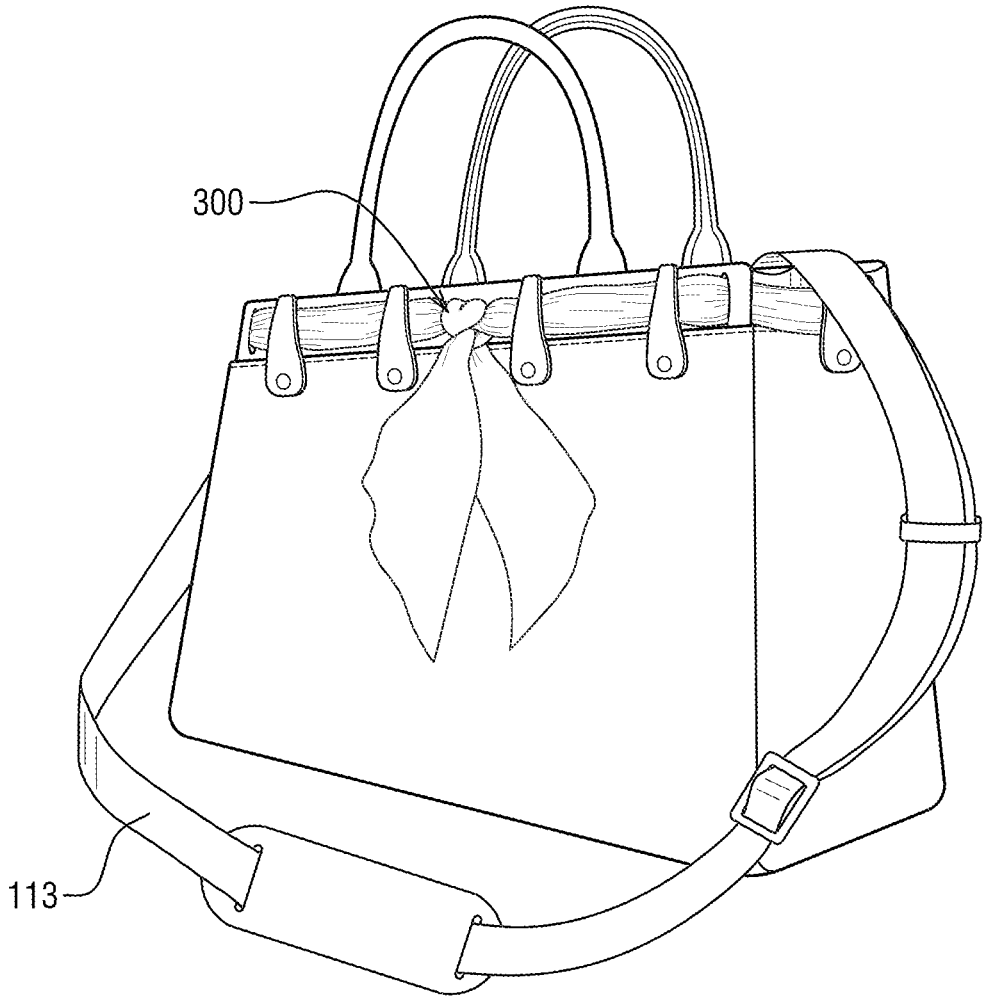
FIG. 11 is a perspective view of the base bag of an embodiment of the present invention with a cover installed and with a scarf-type ancillary elongated element cover.

In another aspect of the invention, hand-carry handles 106 are attached to the upper portion 111 of the base bag 100. In a further aspect of the invention, shoulder straps 113 (FIG. 11) may be attached to the upper portion 111, such as by the interior D-ring 116 (FIG. 10).

Figure 8:
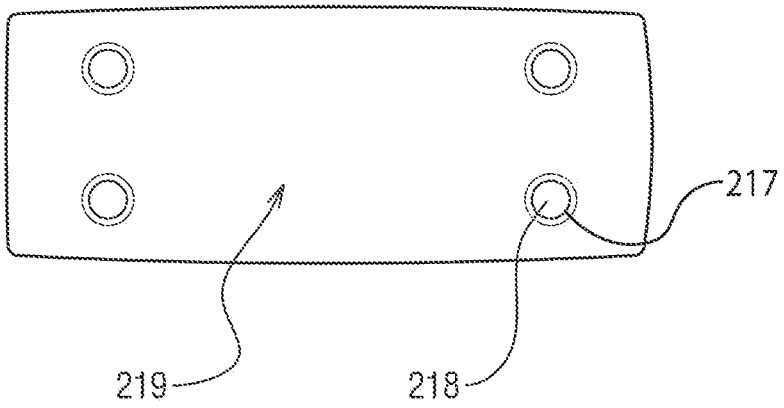
FIG. 8 is a bottom view of the cover of an embodiment of the present invention showing the multiple cover bottom openings configured for receiving the multiple feet of the base bag.

The removable and replaceable cover 200, seen in FIG. 2, includes an open-top, five-sided casing 216. The casing 216 includes a cover back and opposing cover front 203, a cover bottom 219 (FIG. 8), and two opposing cover sides 207. A series of apertures 208 defined by aperture walls 204 is disposed near the top edge 201 of the back and the front 203 of the cover 200. The series of apertures are disposed within the top 20% of the vertical height of the cover 200. Each of the apertures 208 is configured to receive one of the two-connector interconnections 105/115, which serves to hold the cover 200 onto the exterior of the base bag 100.

In one aspect of the invention a stabilization/stiffening reinforcement 202 is included to provide support or fortification to the apertures 208. In an aspect, the top edge 201 is also bolstered with a stabilization/stiffening reinforcement 202 (FIG. 2) to firm the top edge 201 to prevent sagging and to prevent gaps when the cover 200 is attached. The stabilization/stiffening reinforcement 202 may be any stiffener as is known in the art, such as a plastic strip, interfacing, a leather strip, or fabric. The stabilization/stiffening reinforcement 202 may be disposed within the interior of the cover or disposed on the exterior of the cover. When disposed on the exterior of the cover 200, it may be designed to additionally serve to increase the aesthetic appeal or to add decorative value. In another aspect, the apertures 208 are reinforced with edge linings or with grommets, which may be installed with or without the stabilization/stiffening reinforcement 202.

In one aspect of the invention, the cover 200 additionally includes at least one securing flap 210 on each of the two cover sides 207. In this aspect, both cover sides 207 are configured with at least one cover side coupling 205 disposed on the cover side a distance below the point at which the securing flap 210 is attached. The cover side coupling 205 is disposed within the upper portion 211 of the cover side 207, such as near the top edge 201, as seen in FIG. 2.

Each securing flap 210 has a proximal portion attached to the upper portion 211 of the cover, at, near, or inside the top edge 201 of the cover side 207. The distal portion of the cover side securing flap 210 is configured with a flap coupling 215 that is complementary to the cover coupling 205. Thus, the securing flap 210 extends a distance from its proximal attachment point at or near the cover top edge 201 of the cover side 207, forms a loop, and ends at or below the distal attachment point of the complementary cover coupling 215. Preferably, the securing flap 210 has a vertical height greater than its horizontal width.

The connection of the cover side coupling 205 to the side flap coupling 215 forms a coupling-coupling link 205/215. After creation of the coupling-coupling link 205/215, a cover-flap open space is created between the cover exterior and the flap 210 interior. It extends from the top attachment point of the flap downwardly to the coupling-coupling link 205/215. In the aspect in which an ancillary elongated element 300 is included, it may be threaded through this cover-flap open space.

The cover 200 may have a finished exterior with an unfinished interior. Or the cover 200 may have a finished interior and exterior and may be reversible. In an aspect of the invention, the cover 200 is washable.

To use the handbag of the present invention, in one aspect, the base bag 100 may be used alone as a handbag without addition of a cover 200. The base bag open interior compartment 117 will contain the contents desired by the user. If desired, the user may manually attach one or more attachable items 400 to a tab 110 when the base connector 105 and the tab connector 115 are manually connected to form the two-connector interconnection 105/115.

In another aspect, the base bag 100 may be used with a cover 200. In this aspect, without removing the contents of the base bag 100, the look of the handbag may easily be changed. In this aspect, each two-connector interconnection 105/115 (which is the connection formed between the base connector 105 and the tab connector 115) is manually disconnected. The cover 200 is pulled upwardly from the bottom of the base bag 100 to cover the lower portion 109 of the base bag 100 in an orientation corresponding to the orientation of the base bag 100. (For example, the cover front 203 is positioned over base bag front 103.)

A cover first interconnection-receiving aperture 208 defined by aperture wall 204 is manually positioned between a corresponding base connector 105 and the complementary tab connector 115. The base connector 105 and the tab connector 115 are manually aligned and engaged to create a two-connector interconnection 105/115. The two-connector interconnection 105/115 extends through the aperture 208, and, thus, functions to support a portion of the cover top edge 201 in a location near the base bag collar 102. This step is repeated with the second aperture, the third aperture, the fourth aperture, and so on and so forth, until a two-connector interconnection 105/115 has been introduced into each of the apertures of the cover front 203 and on the cover back. This secures the cover 200 over the lower portion 109 of the base bag 100. When desired, the user may manually attach one or more attachable items 400 to a loop-forming tab 110 when interconnecting the base connector 105 and the tab connector 115 or after the interconnection if the attachable item 400 has an openable feature, such as a hook.

The cover 200 may be removed by reversing the cover installation steps. If the cover 200 is reversible, the cover 200 may be turned inside out, and reattached. If the cover 200 is washable, the cover 200 may be washed before another use.

In a further aspect of the invention, multiple covers 200 are provided for use with a single base bag 100. The covers 200 may be provided in different fabrics or materials and in different colors, textures, and designs. This allows the user to select any of the available covers 200 to change the look of the handbag, as desired. Any of the multiple covers may be installed and removed by the method described. If desired, such as for traveling, a second cover can be stacked onto the top of the first cover, so both are conveniently transported to the travel location.

In another aspect of the invention, an ancillary elongated element 300 is provided. FIGS. 3, 9 illustrate the ancillary elongated element 300 as a belt. FIG. n illustrates the ancillary elongated element 300 as a scarf.

This ancillary elongated element 300 may be used with the base bag 100 alone or with the base bag 100 with an attached cover 200. In either instance, the ancillary elongated element 300 is threaded through the series of open spaces disposed below the loop-forming tabs 110 on at least the bag front 103 or the bag back. In one aspect the ancillary elongated element 300 is threaded through the series of tab open spaces disposed below the loop-forming tabs 110 on both the bag front 103 and the bag back.

In the aspect in which the slits are disposed on the base front, base back, and base sides 107, the ancillary elongated element 300 may also be threaded through these slits, as seen in FIG. 3.

In the aspect in which the cover 200 additionally includes a side securing flap 210, if an ancillary elongated element 300 is installed around the collar 102 area within the beltloop-type space 125 created by the series of loop-forming tabs 110, the securing flap 210 is fed behind a portion of the ancillary elongated element 300 and folded over the top of that portion of the ancillary elongated element 300. Then the flap coupling 215 of the loop-forming tab 110 is attached to the cover coupling 205 to cause the ancillary elongated element 300 to be held within the cover-flap open space within the flap 210 and is supported on the side 207 to provide a tidy appearance. Alternatively, the flap coupling 215 can be first attached to the cover coupling 205 with the ancillary elongated element 300 then threaded through the cover-flap open space created.

In another aspect of the invention, if no ancillary elongated element 300 is installed, the cover side securing flap 210 may still be used. In this aspect, the base bag 100 is further configured with a base bag side band 121 that extends horizontally a sufficient distance (is sufficiently wide enough) to receive the side securing flap 210. If no elongated element 300 is available around which to loop the flap 210, the flap 210 can be threaded behind and curled over the top of this band 121.

The side band 121 may be formed of an attached separate piece of material or may be formed integrally, as seen in FIG. 12 in which parallel horizontal fissures 122 (defined by fissure edges 123) form the band 121. In this aspect, the securing flap 210 is fed behind the band 121 of base bag material. It is then folded over the top of the band 121, and the flap coupling 215 of the securing flap 210 is attached to the cover side coupling 205.

In this variation of the invention, a first band 121 includes two opposing ends and a middle section. Each of the two opposing ends are attached to (removably connected to, fixedly connected to, or formed integrally with) the right side of the base bag. And a second band 121 includes two opposing ends and a middle section, with each of the two opposing ends attached to the left side of the base bag. The middle section of the right-side band 121 and of the left side band 121 are not attached, so a channel is formed underneath the middle sections. This channel allows the cover side securing flap 210 to be looped through (and under) the middle section and curled over the top of the middle section to extend downwardly to allow the cover side coupling 205 to snap or attach to the flap coupling 215.

In a preferred aspect of the invention, the base bag 100 further includes feet 118 at least in the area of the four corners of the base bag bottom 119. Additional feet 118 may be included if desired. The feet 118 are preferably formed of a material that provides sufficient support for the handbag and its contents, such as a hard plastic material, wood, bamboo, or other rigid material. In this variation of the invention, the cover 200 includes cover bottom openings 218 defined by bottom opening edges 217 that are disposed on the bottom panel 219 of the cover 200. They correspond in size and location to the feet 118 of the base bag 100. The cover bottom openings 218 are reinforced by a stabilizing material or formed of a reinforced liner, such as a grommet or the like. When the cover 200 is installed onto the base bag 100 the feet 118 are aligned with the cover bottom openings 218 so that the feet protrude through the cover bottom openings 218. Thus, the cover bottom panel 219 is slightly elevated above the ground, which protects the cover 200 from wear and tear.

In one aspect, a kit of the present invention may suitably consist of one base bag 100 and one cover 200. In another aspect, a kit of the present invention may suitably consist of one base bag 100 and multiple covers 200. In a further aspect, a kit of the present invention may suitably consist of one base bag 100, at least one cover 200, and at least one ancillary elongated element 300.

The base bag 100 and the cover 200 may be formed of any of a variety of conventional handbag materials including, but not limited to, natural leather, manmade leather, fabric, metallic material, or the like. The cover 200 may be formed of the same conventional handbag material as the base bag 100 or may be formed of a different material.

Thus, the handbag of the present invention provides a base bag 100 usable alone, an interchangeable cover 200 attachable to the base bag 100, and multifunction tabs disposed on the base bag 100 that can be utilized to fasten attachable items 400, to hold an ancillary elongated element 300 in position along the top of the base bag 100, and/or to secure the cover 200. These functions are provided while not using dedicated-purpose zippers as cover-attachment elements for interchanging the cover.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A handbag, comprising:

a base bag comprising:

a base bag front, an opposing base bag back, a base bag right side, a base bag left side, and a base bag bottom;

multiple base connectors disposed in a front base connector series on an upper portion of said base bag front and disposed in a back base connector series on an upper portion of said base bag back;

multiple loop-forming tabs comprising multiple front loop-forming tabs and multiple back loop-forming tabs; wherein said multiple front loop-forming tabs are attached at or near the upper edge of said base bag front in a front tab series; and wherein said multiple back loop-forming tabs are attached at or near the upper edge of said base bag back in a back tab series; and multiple tab connectors each of which is disposed on one of said multiple loop-forming tabs and each of which is complementary to, and attachable to and detachable from, one of said multiple base connectors; wherein, when one of said multiple base connectors is joined to one of said multiple tab connectors, a two-connector interconnection is formed and beltloop-type open spaces are defined between an exterior of said base bag and an interior of said multiple loop-forming tabs; and said handbag further comprising a cover sized and shaped to, when attached to said base bag, conceal over one half of said base bag, said cover comprising apertures defined by aperture walls; wherein said apertures are disposed along an upper portion of said cover in a location corresponding to said front base connector series and in a location corresponding to said back base connector series; wherein each of said apertures is configured to accommodate said two-connector interconnection.

2. The handbag as recited in claim 1, wherein said cover further comprises:

two cover side portions;

two cover side couplings each of which is disposed on one of said two cover side portions;

two cover side securing flaps each of which has a proximal portion attached to one of said two cover side portions; and two flap couplings each of which is disposed on one of said two cover side securing flaps; wherein said two flap couplings are complementary to said two cover side couplings; and wherein, when said two cover side couplings are connected to said two flap couplings, two cover side securing flap loops are formed.

3. The handbag as recited in claim 2, wherein:

said base bag right side comprises a horizontally extending right-side band comprising opposing right-side ends attached to said base bag right side and a non-attached right-side middle section that defines a right-side channel that accommodates a first one of said cover side securing flaps; and said base bag left side comprises a horizontally extending left-side band comprising opposing left-side ends attached to said base bag left side and a non-attached left-side middle section that defines a left-side channel that accommodates a second one of said cover side securing flaps.

4. The handbag as recited in claim 2, wherein:

said base bag front comprises front right and left through-slits defined by front right and left through-slit edges, respectively;

said base bag back comprises back right and left through-slits defined by back right and left through-slit edges, respectively;

said base bag left side comprises two left side through-slits defined by left-side through-slit edges; and said base bag right side comprises two right side through-slits defined by right-side through-slit edges.

5. The handbag as recited in claim 4, further comprising an ancillary elongated element; wherein:

said beltloop-type open spaces accommodate said ancillary elongated element;

said two cover side securing flap loops accommodate said ancillary elongated element;

said front right and left through-slits accommodate said ancillary elongated element;

said back right and left through-slits accommodate said ancillary elongated element;

said two left side through-slits accommodate said ancillary elongated element; and said two right side through-slits accommodate said ancillary elongated element.

6. The handbag as recited in claim 5, wherein said ancillary elongated element comprises one of a belt, a scarf, a rope, or a chain.

7. The handbag as recited in claim 2, wherein:

said base bag bottom further comprises at least four feet projecting downwardly; and said cover comprises a cover bottom panel comprising cover bottom openings defined by cover bottom opening edges that correspond in number and location to said feet; each of said cover bottom openings configured to accommodate one of said feet and to allow said one of said feet to extend below said cover bottom panel.

8. The handbag as recited in claim 1, wherein:

said base bag right side comprises a horizontally extending right-side band comprising attached opposing right-side ends and a non-attached right-side middle section that defines a right-side channel that accommodates a first cover side securing flap; and said base bag left side comprises a horizontally extending left-side band comprising attached opposing left-side ends and a non-attached left-side middle section that defines a left-side channel that accommodates a second cover side securing flap.

9. A handbag, comprising:

a base bag comprising:

a base bag front, an opposing base bag back, a base bag right side, a base bag left side, and a base bag bottom;

multiple base connectors disposed in a front base connector series on an upper portion of said base bag front and disposed in a back base connector series on an upper portion of said base bag back;

multiple loop-forming tabs comprising multiple front loop-forming tabs and multiple back loop-forming tabs; wherein said multiple front loop-forming tabs are attached at or near the upper edge of said base bag front in a front tab series; and wherein said multiple back loop-forming tabs are attached at or near the upper edge of said base bag back in a back tab series; and multiple tab connectors each of which is disposed on one of said multiple loop-forming tabs and each of which is complementary to, and attachable to and detachable from, one of said multiple base connectors; wherein, when one of said multiple base connectors is joined to one of said multiple tab connectors, a two-connector interconnection is formed and beltloop-type open spaces are defined between an exterior of said base bag and an interior of said multiple loop-forming tabs; and said handbag further comprising an ancillary elongated element; wherein said beltloop-type open spaces accommodate said ancillary elongated element; wherein said base bag right side comprises a horizontally extending right-side band comprising attached opposing right-side ends and a non-attached right-side middle section that defines a right-side channel that accommodates a first cover side securing flag; and said base bag left side comprises a horizontally extending left-side band comprising attached opposing left-side ends and a non-attached left-side middle section that defines a left-side channel that accommodates a second cover side securing flag.

10. The handbag as recited in claim 9, wherein:

said base bag front comprises front right and left through-slits defined by front right and left through-slit edges, respectively; wherein said front right and left through-slits accommodate said ancillary elongated element;

said base bag back comprises back right and left through-slits defined by back right and left through-slit edges, respectively; wherein said back right and left through-slits accommodate said ancillary elongated element;

said base bag left side comprises two left-side through-slits each defined by one of two left-side through-slit edges; wherein said two left-side through-slits accommodate said ancillary elongated element; and said base bag right side comprises two right-side through-slits each defined by one of two right-side through-slit edges; wherein said two right-side through-slits accommodate said ancillary elongated element.

11. The handbag as recited in claim 10, further comprising a cover; said cover comprising two cover side securing flap loops that accommodate said ancillary elongated element.

12. The handbag as recited in claim 11, wherein said ancillary elongated element comprises one of a belt, a scarf, a rope, or a chain.

13. A handbag, comprising:

a base bag comprising:

a base bag front, an opposing base bag back, a base bag right side, a base bag left side, and a base bag bottom;

multiple base connectors comprising: at least three front base connectors disposed in a front base connector series on an upper portion of said base bag front, and comprising at least three back base connectors disposed in a back base connector series on an upper portion of said base bag back;

multiple loop-forming tabs comprising at least three front loop-forming tabs attached at or near the upper edge of said base bag front in a front tab series, and comprising at least three back loop-forming tabs attached at or near the upper edge of said base bag back tab series; and multiple tab connectors each of which is disposed on one of said multiple loop-forming tabs and each of which is complementary to, and attachable to and detachable from, one of said multiple base connectors; wherein, when one of said multiple base connectors is joined to one of said multiple tab connectors, a two-connector interconnection is formed and beltloop-type open spaces are defined between an exterior of said base bag and an interior of said multiple loop-forming tabs.

14. The handbag of claim 13, further comprising:

a cover sized and shaped to, when attached to said base bag, conceal over one half of said base bag; said cover comprising:

a cover front;

an opposing cover back;

two cover sides;

a cover bottom; and interconnection-receiving apertures defined by aperture walls that extend through said cover; wherein said interconnection-receiving apertures comprise at least three apertures disposed along an upper portion of said cover front in a location corresponding to said front base connector series to form a cover front aperture series; wherein said interconnection-receiving apertures further comprise at least three apertures disposed along an upper portion of said cover back in a location corresponding to said back base connector series to form a cover back aperture series; wherein each of said interconnection-receiving apertures is configured to accommodate said two-connector interconnection.

15. The handbag as recited in claim 14, wherein said cover further comprises:

two cover side couplings each of which is disposed on one of said two cover sides;

two cover side securing flaps each of which has a proximal portion attached to an upper portion of one of said two cover sides; and two flap couplings each of which is disposed on one of said two cover side securing flaps; wherein said two flap couplings are complementary to said two cover side couplings; and wherein, when said two cover side couplings are connected to said two flap couplings, two cover side securing flap loops are formed.

16. The handbag as recited in claim 15, wherein:

said base bag right side comprises a right-side band horizontally extending between a right-side first band end attached to said base bag right side and a right-side second band end attached to said base bag right side; said right-side band comprising a right-side band middle section that is disposed between said right-side first band end and said right-side second band end and that is not attached to said base bag right side; wherein a right-side channel is defined behind said right-side band middle section; wherein said right-side channel accommodates one of said cover side securing flaps; and said base bag left side comprises a left-side band horizontally extending between a left-side first band end attached to said base bag left side and a left-side second band end attached to said base bag left side; said left-side band comprising a left-side band middle section that is disposed between said left-side first band end and said left-side second band end and that is not attached to said base bag left side; wherein a left-side channel is defined behind said left-side band middle section; and wherein said left-side channel accommodates one of said cover side securing flaps.

17. The handbag of claim 16, wherein:

said base bag right side comprises a right-side band horizontally extending between a right-side first band end attached to said base bag right side and a right-side second band end attached to said base bag right side; said right-side band comprising a right-side band middle section disposed between said right-side first band end and said right-side second band end and not attached to said base bag right side; wherein a right-side channel is defined behind said right-side band middle section; and said base bag left side comprises a left-side band horizontally extending between a left-side first band end attached to said base bag left side and a left-side second band end attached to said base bag left side; said left-side band comprising a left-side band middle section disposed between said left-side first band end and said left-side second band end and not attached to said base bag left side; wherein a left-side channel is defined behind said right-side band middle section.

18. The handbag as recited in claim 14, wherein said cover is reversible.

19. The handbag as recited in claim 13, wherein:

said base bag front comprises front right and left through-slits defined by front right and left through-slit edges, respectively, and disposed near a right upper corner of said base bag front and near a left upper corner of said base bag front, respectively;

said base bag back comprises back right and left through-slits defined by back right and left through-slit edges, respectively, and disposed near a right upper corner of said base bag back and near a left upper corner of said base bag back, respectively;

said base bag left side comprises left-side right and left through-slits defined by left-side right and left through-slit edges, respectively, and disposed near a right upper corner of said base bag left side and near a left upper corner of said base bag left side, respectively; and said base bag right side comprises right-side right and left through-slits defined by right-side right and left through-slit edges, respectively, and disposed near a right upper corner of said base bag right side and near a left upper corner of said base bag left side, respectively.

20. The handbag as recited in claim 19, further comprising an ancillary elongated element; wherein said ancillary elongated element is received by said beltloop-type open spaces, said two cover side securing flap loops, said front right and left through-slits, said back right and left through-slits, said left-side right and left through-slits, and said right-side right and left through-slits.

21. The handbag as recited in claim 13, further comprising an ancillary elongated element; wherein said beltloop-type open spaces accommodate said ancillary elongated element.

* * * * *